US005690258A

United States Patent [19]

Kataoka

[11] Patent Number: 5,690,258

[45] Date of Patent: Nov. 25, 1997

[54] BABY CARRIER

[75] Inventor: Sachiyo Kataoka, Tokyo, Japan

[73] Assignee: Aprica Kassai Kabushikikaisha, Osaka, Japan

[21] Appl. No.: 713,795

[22] Filed: Sep. 13, 1996

[30] Foreign Application Priority Data

Sep. 13, 1995 [JP] Japan ..... 7-262361

[51] Int. Cl.[6] ..... A61G 1/00

[52] U.S. Cl. ..... 224/160; 224/158; 297/467

[58] Field of Search ..... 224/158, 159, 224/160, 161; 297/465, 467; 280/87.051, 30, 643, 648; 482/66, 67, 68, 69

[56] References Cited

U.S. PATENT DOCUMENTS

| | | | |
|---|---|---|---|
| 831,402 | 9/1906 | Austin . | |
| 2,376,657 | 5/1945 | Chamberlain | 224/159 |
| 2,456,319 | 12/1948 | Read . | |
| 3,575,326 | 4/1971 | Chappell | 224/159 |
| 3,780,919 | 12/1973 | Hansson | 224/160 |
| 4,009,808 | 3/1977 | Sharp . | |
| 4,139,130 | 2/1979 | Glusker et al. . | |
| 4,434,920 | 3/1984 | Moore | 224/160 |
| 4,492,326 | 1/1985 | Storm | 224/160 |
| 4,579,264 | 4/1986 | Napolitano . | |
| 4,731,912 | 3/1988 | Boriskie et al. . | |
| 4,825,515 | 5/1989 | Wolterstorff, Jr. . | |
| 4,987,662 | 1/1991 | Haffey et al. . | |
| 5,020,709 | 6/1991 | Hoaglan . | |
| 5,129,129 | 7/1992 | Collins et al. . | |
| 5,195,666 | 3/1993 | Yamaguchi et al. . | |
| 5,205,451 | 4/1993 | Manzer . | |
| 5,246,152 | 9/1993 | Dotseth . | |
| 5,297,852 | 3/1994 | Morales-Quintero | 297/467 |
| 5,311,649 | 5/1994 | Suh . | |
| 5,490,620 | 2/1996 | Bergqvist . | |

FOREIGN PATENT DOCUMENTS

| | | |
|---|---|---|
| 0087063 | 8/1983 | European Pat. Off. . |
| 0611234 | 8/1994 | European Pat. Off. . |
| 1545820 | 11/1968 | France . |
| 61-25400 | 7/1986 | Japan . |
| 2-71359 | 5/1990 | Japan . |
| 4-17064 | 4/1992 | Japan . |
| 4-28435 | 7/1992 | Japan . |
| 4-45567 | 10/1992 | Japan . |
| 2236794 | 4/1991 | United Kingdom . |
| WO9212656 | 8/1992 | WIPO . |
| WO9216130 | 10/1992 | WIPO . |

OTHER PUBLICATIONS

The Journal of The American Medical Association, vol. 168. No. 7, p. 930, Oct. 1958.

*Primary Examiner*—David J. Walczak
*Assistant Examiner*—Gregory M. Vidovich
*Attorney, Agent, or Firm*—W. G. Fasse; W. F. Fasse

[57] ABSTRACT

A baby carrier includes a carrier body having a front cover portion, a crotch cover portion, and a back cover portion which are integrally formed in continuation of one another. The carrier body is made up of a first cloth material including the front cover portion, a fifth cloth material for the crotch cover portion, and a fourth cloth material for the back cover portion which are respectively severed from one another at a midsection of the crotch cover portion and at border portions of the crotch cover portion and back cover portion. The first and fifth cloth materials have a concave edge configuration at their respective border portions. The fourth and fifth cloth materials have a convex edge configuration at their respective border portions. The concave edge portions of the first and fifth cloth materials are sewn together, and likewise the convex edge portions of the fourth and fifth cloth materials are sewn together, whereby the carrier body is integrally formed as such. The crotch cover portion is fitted with a pad as a cushioning material. A pair of shoulder belts extend from both sides of a distal end of the front cover portion. At the surface side of the carrier body there are provided first and second belt members which intersect each other at the crotch cover portion.

20 Claims, 8 Drawing Sheets

BABY CARRIER

CROSS-REFERENCE TO RELATED APPLICATION

This application is related to copending application U.S. Ser. No. 08/534,254, which was filed on Sep. 26, 1995 and has a common assignee herewith.

BACKGROUND OF THE INVENTION

The present invention relates to a baby carrier or baby nursing supporter for carrying a baby while holding the baby therein.

Hitherto, bag-type baby carriers have been known in the art. One example of such type of baby carrier is disclosed in Japanese Utility Model Publication No. 4-17064 wherein a carrier body which is of a planar form in its unfolded state is assembled into a bag-form structure such that a baby can be accommodated in the bag-form carrier body.

However, when a carrier body which is primarily of a flat shade is assembled into a bag-form structure, the interior of the carrier body will not comfortably fit the crotch and hid configurations of a baby, because the crotch and hip portions of the baby have a three-dimensional configuration with convex and concave features.

This poses a problem that the crotch cover portion of the carrier body which is to support the larger part of the weight of the baby can only come in contact with some part of the crotch and hip portions of the baby, so that the surface pressure on the crotch and hip portions of the baby is unevenly distributed. As a result, problems may occur, for example, the crotch and hip portions of the baby may locally get swollen, irritated and red; and the hip joint of the baby is exposed to pressure which, in some extreme case, may lead to hip joint dislocation.

This invention is directed to solving such a problem with the prior art and, therefore, it is an object of the invention to provide a baby carrier which permits uniform distribution of such surface pressure as may act on a baby in the carrier body.

Further objects and advantages of the present invention will be understood from the detailed description that follows.

SUMMARY OF THE INVENTION

The present invention pertains to a baby carrier for carrying a baby while holding the baby therein. According to the invention, there is provided a baby carrier including a carrier body having a front cover portion, a crotch cover portion, and a back cover portion which are integrally formed in continuation of one another.

According to one embodiment of the invention, a carrier body is comprised of a first cloth material including the front cover portion and a second cloth material for a back cover portion which are severed at a midsection of the crotch cover portion. The first and second cloth materials each have an edge portion of a concave pattern which defines a respective border portion. These edge portions are sewn together whereby the carrier body is formed as such. Preferably, the crotch cover portion is internally fitted with a pad which acts as a cushioning material.

In another embodiment, a carrier body is comprised of a third cloth material including a crotch cover portion and a fourth cloth material for the back cover portion which are severed at border portions of the crotch cover portion and back cover portion. The third and fourth cloth materials each have an edge portion of convex pattern which defines a respective border portion. These edge portions are sewn together whereby the carrier body is formed as such.

In still another embodiment, a carrier body is comprised of a first cloth material including a front cover portion, a fifth cloth material for the crotch cover portion, and a fourth cloth material for the back cover portion which are severed respectively at a midsection of a crotch cover portion and at border portions of the crotch cover portion and back cover portion. The first and fifth cloth materials each have an edge portion of concave pattern which defines a respective border portion. The fourth and fifth cloth materials each have an edge portion of convex pattern which defines a respective border portion. The concave edge portions of the first and fifth cloth materials are sewn together, and likewise the convex edge portions of the fourth and fifth cloth materials are sewn together, whereby the carrier body is formed as such. In this embodiment, too, it is preferable that the crotch cover portion is internally fitted with a pad which acts as a cushioning material.

In a further embodiment, the baby carrier includes a pair of shoulder belts extending downward from lower opposite ends of the front cover portion, and first and second belt members which intersect each other at the crotch cover portion on the surface side of the carrier body (wherein the relative directions pertain to the orientation of the baby carrier as shown in the present drawing FIGS. 1 to 3).

The shoulder belts are fitted at respective upper portions thereof with buckles with a protective cover attached thereto and, at lower ends, with one-touch buckles. Portions of the first and second belt members, lower than the point of their intersection, extend obliquely downward from the lower edge of the crotch cover portion in such a manner that the belt members come closer to each other toward their lower ends. Each of the belt members is fitted at its lower end with a one-touch buckle which is releasably engageable with a corresponding one of the one-touch buckles of the shoulder belts. Upper portions of the first and second belt members, that is, portions above their intersecting point, are disposed in the back cover portion in or on such a way that they are located closer to each other toward their upper ends. Each belt member is fitted at its upper end with a one-touch buckle which is releasably engageable with the protective cover-fitted buckle of the corresponding shoulder belt.

DETAILED DESCRIPTION OF THE PREFERRED EMBODIMENTS

Figure 1:
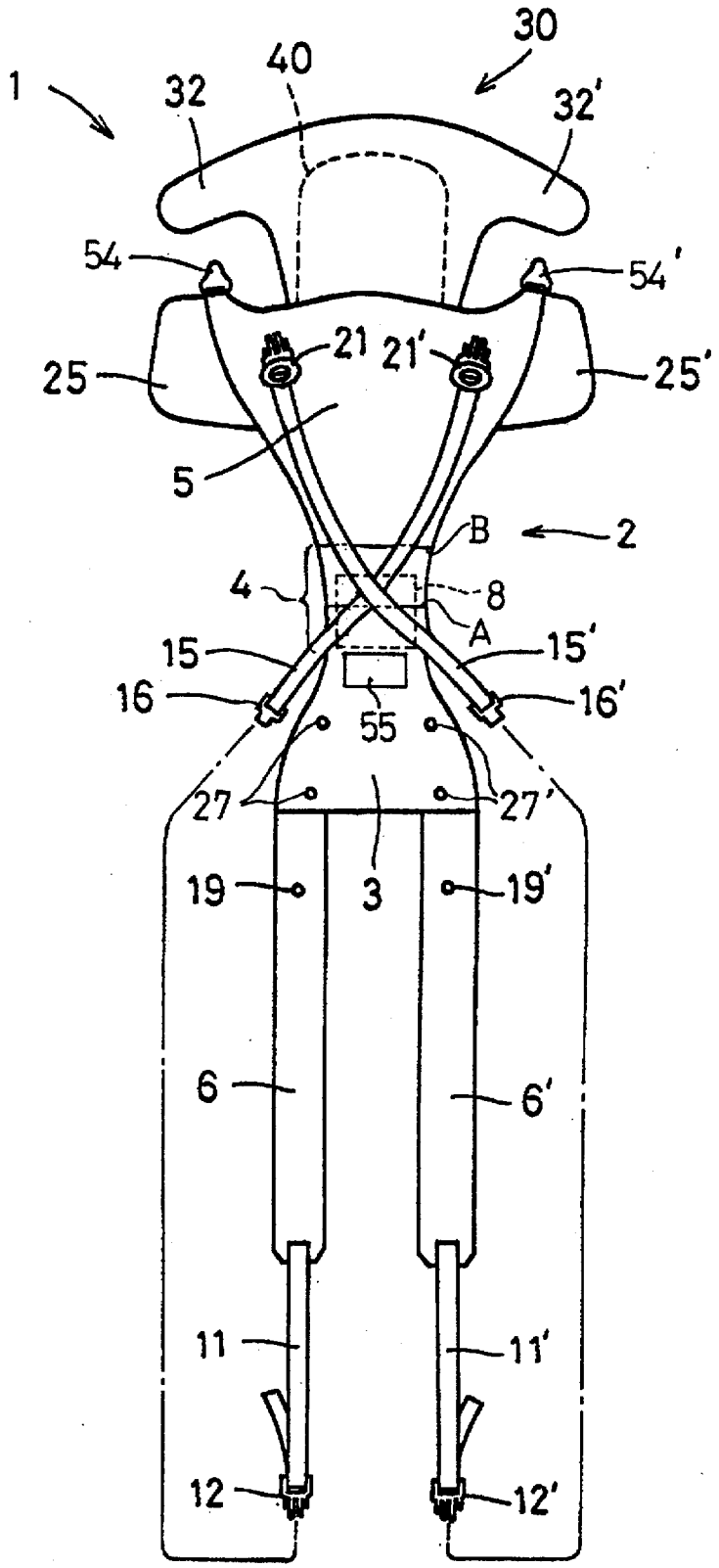
FIG. 1 is a surface view of a baby carrier, in a developed state, according to one embodiment of the present invention.
Figure 2:
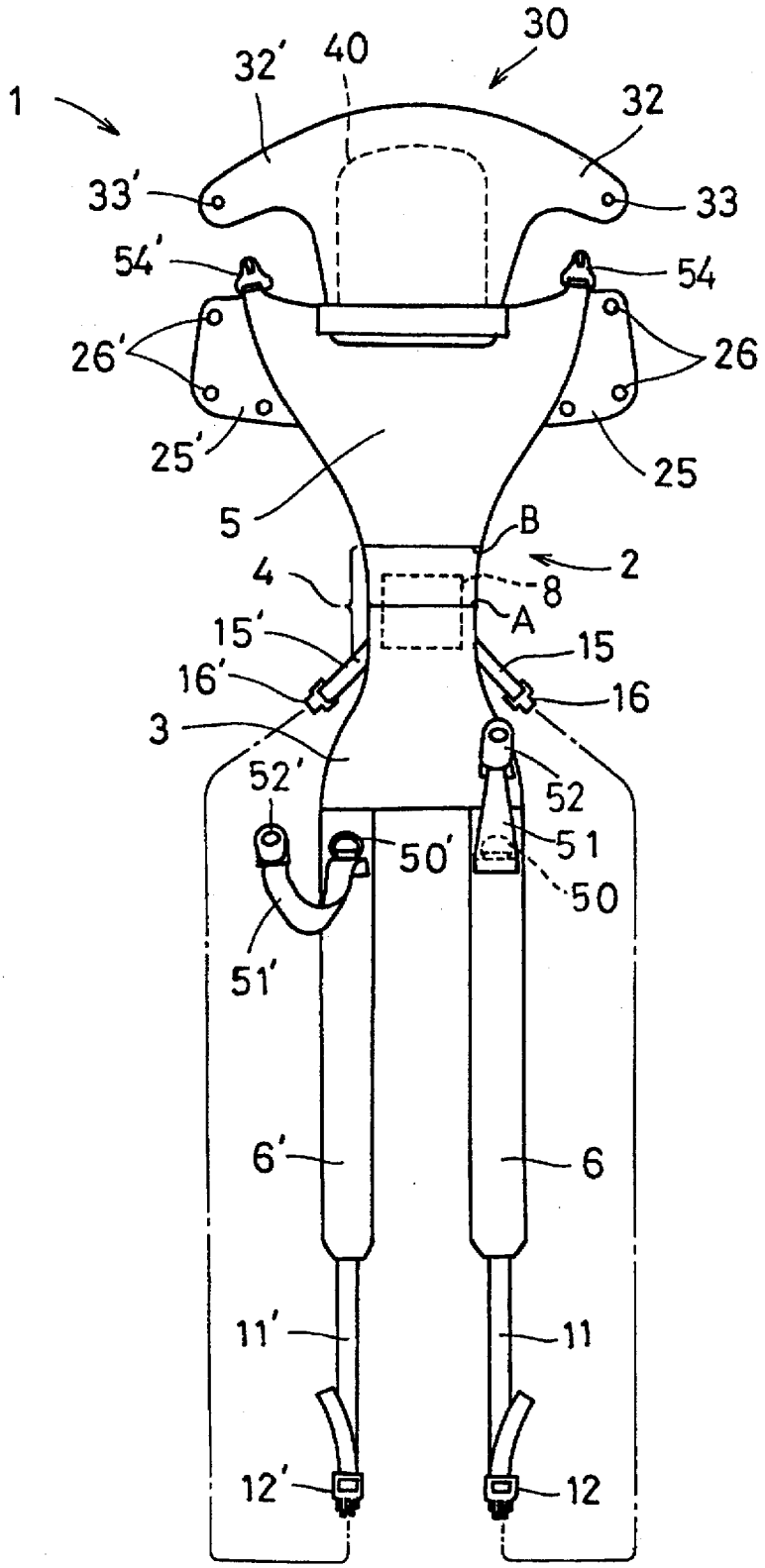
FIG. 2 is a back surface view of the baby carrier of FIG. 1 in developed state.

As FIGS. 1 and 2 illustrate, a baby carrier 1 includes a carrier body 2 having a front cover portion 3, a narrow crotch cover portion 4, and a back cover portion 5 for respectively supporting abdominal, crotch and back portions of a baby, the cover portions being integrally formed in continuation of one another.

Figure 3:
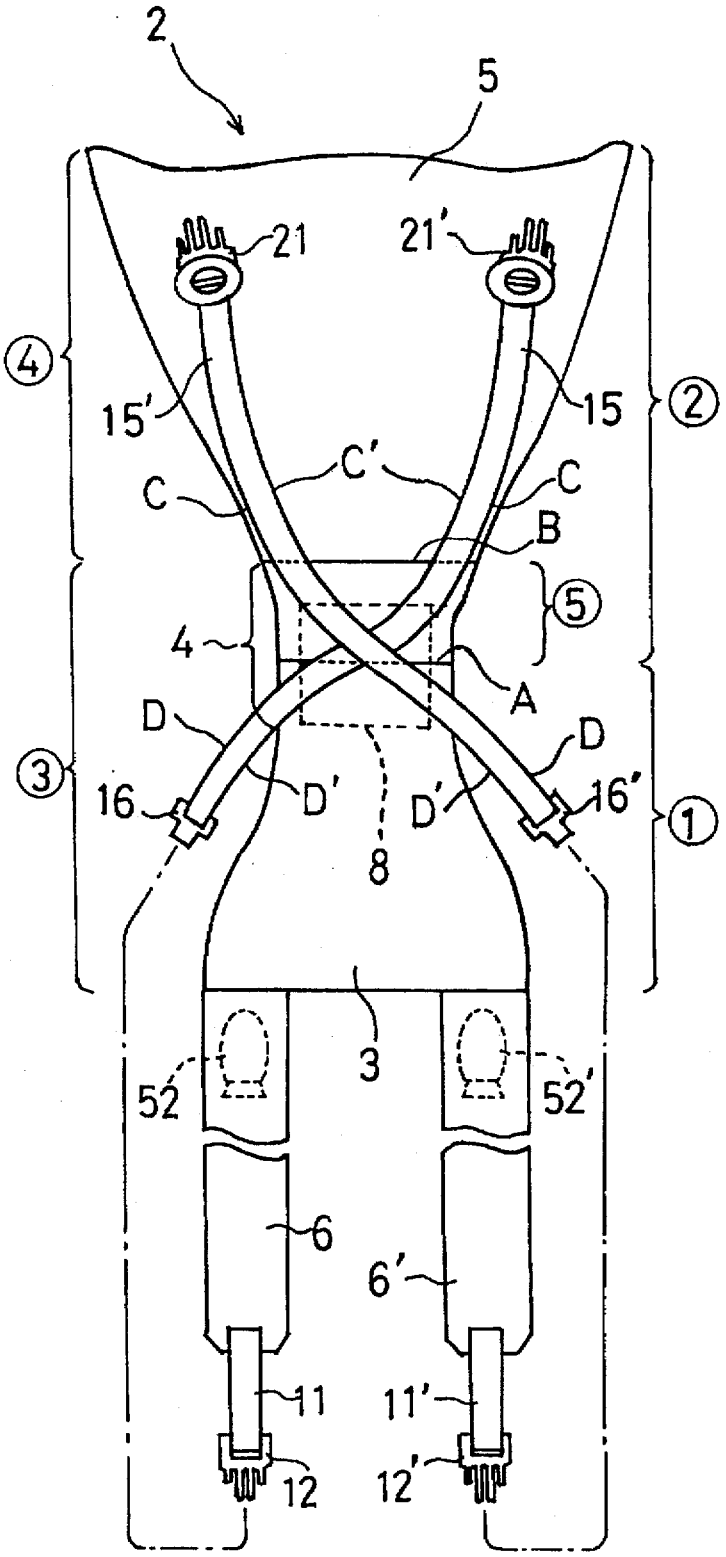
FIG. 3 is an enlarged view for explaining the construction of the baby carrier.

The carrier body 2, as FIG. 3 shows, is comprised of a first cloth material ① including the front cover portion 3 which is cut centrally of the crotch cover portion 4 along a cut edge A, a fifth cloth material ⑤ for the crotch cover portion 4, and a fourth cloth material ④ for the back cover portion 5, wherein a border between the crotch cover portion 4 and the back cover portion 5 is defined along a cut edge B. The cloth materials ①, ⑤, ④ are sewn together to integrally form the carrier body 2 as such.

Figure 4:
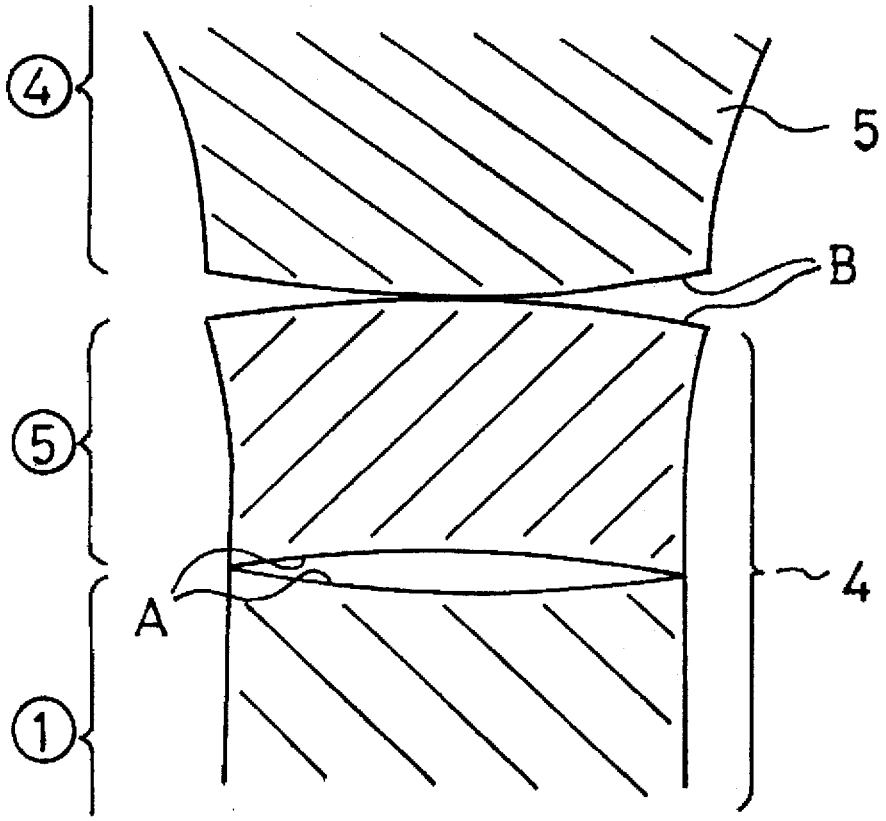
FIG. 4 is a detail view showing a portion of a carrier body prior to sewing up.
Figure 5:
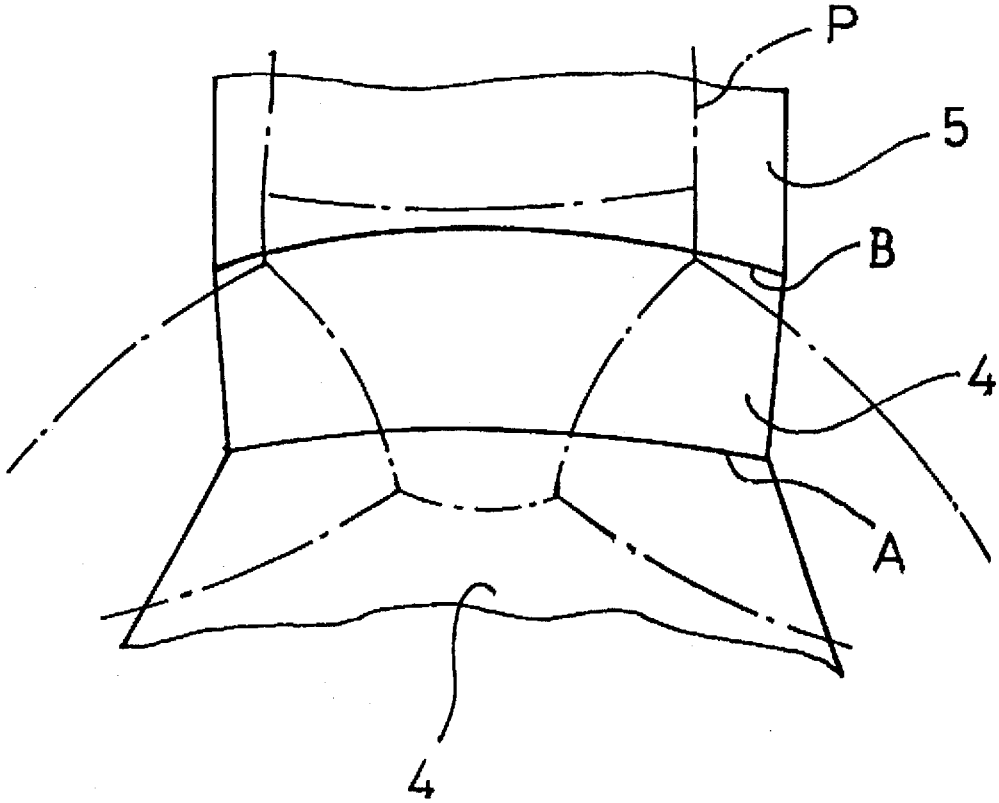
FIG. 5 is an enlarged detail view of boundary edge portions of constituent cloth materials of the carrier body in sewn-up condition.

Respective cut edges A of the first cloth material ① and fifth cloth material ⑤ each have a concave configuration as shown in FIG. 4. Therefore, when cut edges A of the first cloth material ① and fifth cloth material ⑤ are sewn together, as may be seen from the border line (cut edge) A in FIG. 5, that part of a crotch cover portion which will come in contact with the crotch of a baby P is formed in a raised or upwardly curved fashion, and portions extending laterally to both thighs are formed in a gradually sinking curved fashion. As a result, a border line A of a three-dimensional makeup is obtained which can suitably fit the crotch and thigh portions of baby P. Thus, when the baby is accommodated in the baby carrier 1, any surface pressure exerted on the crotch of the baby can be uniformly distributed.

Respective cut edges B of the fifth cloth material ⑤ and fourth cloth material ④ each have a convex configuration as shown in FIG. 4. Therefore, when cut edges B of the fifth cloth material ⑤ and fourth cloth material ④ are sewn together, as may be seen from FIG. 5, the crotch portion 4 between the border line A and the border line (cut edge) B can be contoured three-dimensionally, for example concavely along the configuration of baby P. Thus, when the baby is accommodated in the baby carrier 1, any surface pressure exerted on the hip of the baby can be uniformly distributed.

The crotch cover portion 4 is internally fitted with a pad 8 which acts as a cushioning material. This pad 8 is intended to serve for purposes of protecting the crotch joint of the baby and alleviating any feel of pressure on the crotch joint.

The front cover portion 3 is fitted at a lower end portion thereof with a pair of shoulder belts 6, 6'. The shoulder belts 6, 6' are fitted at their respective lower ends with one-touch buckles 12, 12' through length-adjustable belt members 11, 11'. The shoulder belts 6, 6' are fitted at their upper ends with ring members 50, 50' of generally D-shape configuration respectively.

Affixed adjacent each ring member 50, 50' is a belt member 51, 51' which is fitted at its distal end with a protective cover-equipped buckle 52, 52'. Each protective cover-equipped buckle 52, 52' comprises a one-touch buckle (not shown) to which a respective distal end of the belt member 51, 51' is secured, and an open-close controllable protective cover 53, 53' which covers a control portion of the one-touch buckle (see FIG. 6).

Attached to a lower portion of the crotch cover portion 4 are belt members 15, 15' which extend obliquely downward. The belt members 15, 15' are fitted at the lower ends thereof with one-touch buckles 16, 16' which are releasably engageable with the earlier mentioned one-touch buckles 12, 12'.

The belt members 15, 15' are so arranged as to extend obliquely upward over the crotch cover portion 4 and the back cover portion 5, intersecting each other at the crotch cover portion 4. The belt members 15, 15' are sewn on the crotch cover portion 4 and back cover portion 5. At their upper ends, the belt members 15, 15' are fitted with one-touch buckles 21, 21' which are releasably engageable with respective one-touch buckles of the protective cover-equipped buckles 52, 52'.

The belt members 15, 15' are generally linear in configuration prior to their being attached to the carrier body 2, but when sewn on the carrier body 2, the belt members 15, 15' are of such configuration that in a region above their intersection the belt members 15, 15' curve toward each other. That is, as may be seen from FIG. 3, outer surface C of respective belt member 15, 15' is convexly contoured and inner surface C' is concavely contoured.

Attached in position in such a manner, the inner surface C' of respective belt member 15, 15' is in somewhat contracted condition so that the underside (which comes in contact with the baby) of the back cover portion 5 is liable to sink or deflect. Therefore, when the baby is accommodated in the baby carrier 1, the back cover portion 5 is depressed to conform to the contour of the back of the baby, so that any surface pressure exerted on the back of the baby can be uniformly distributed. The cross angle of the belt members 15, 15' opening upward and outward at the point of their intersection is an obtuse angle and, as a result, the contour of the carrier body 2 over a region extending from the crotch cover portion 4 to the back cover portion 5 tends to become more roundish or curved.

Those parts of the belt members 15, 15' which extend downward from the point of their crossing are disposed in such a manner that they curve toward each other. In FIG. 3, the outer surface D of respective belt member 15, 15' presents a convex surface, and the inner surface D' present a concave surface.

Thus, when the baby carrier 1 is assembled for use, lower portions of the belt members 15, 15' are arranged along the body of a baby sitter or nursing person, so that the belt members 15, 15' and shoulder belts 6, 6' to which they are connected are arranged close to the body of the nursing person. This enables the nursing person to bear the weight of the baby without difficulty. When the baby carrier 1 is secured in position in the above described manner, each belt member 15, 15', as a whole, presents a curved configuration of a generally S-shaped form (see FIG. 3).

Adjacent the upper edge of the back cover portion 5 there are provided side supports 25, 25' for supporting sides of the body of the baby, the side supports 25, 25' projecting laterally from opposite sides of the back cover portion 5. The side supports 25, 25' are provided with locking hooks or fasteners 26, 26' which are releasably engageable with locking hooks or fasteners 27, 27' attached to the front cover portion 3 at both sides.

Attached to upper opposite ends (shoulder portions) of the back cover portion 5 are hook members 54, 54' which are releasably engageable with the ring members 50, 50'. A head support 30 for supporting the head of the baby from behind is removably mounted at an upper center location of the back cover portion 5. Opposite sides 32, 32' of the head support 30 are fitted at their distal ends with locking hooks or fasteners 33, 33' which are releasably engageable with locking hooks or fasteners 19, 19' attached to respective upper portions of the shoulder belts 6, 6'.

The crotch portion 4 is provided with a belt loop 55 through which a waist belt (not shown) is to be removably fitted around of the waist of the baby sitter.

Next, the manner of use of the baby carrier 1 will be briefly explained.

When receiving a baby into the baby carrier 1, the necessary procedure to be carried out is as follows. With the surface side of the baby carrier 1 directed toward the nursing person, the shoulder belts 6, 6' are first placed on the shoulders of the nursing person and the one-touch buckles 12, 12' at distal ends of the shoulder belts 6, 6' are respectively brought into engagement with the one-touch buckles 16, 16' of the belt members 15, 15' (see one-dot chain line in FIGS. 1 and 2). At this point of time, the back side (FIG. 2) is exposed to the outside.

Figure 6:
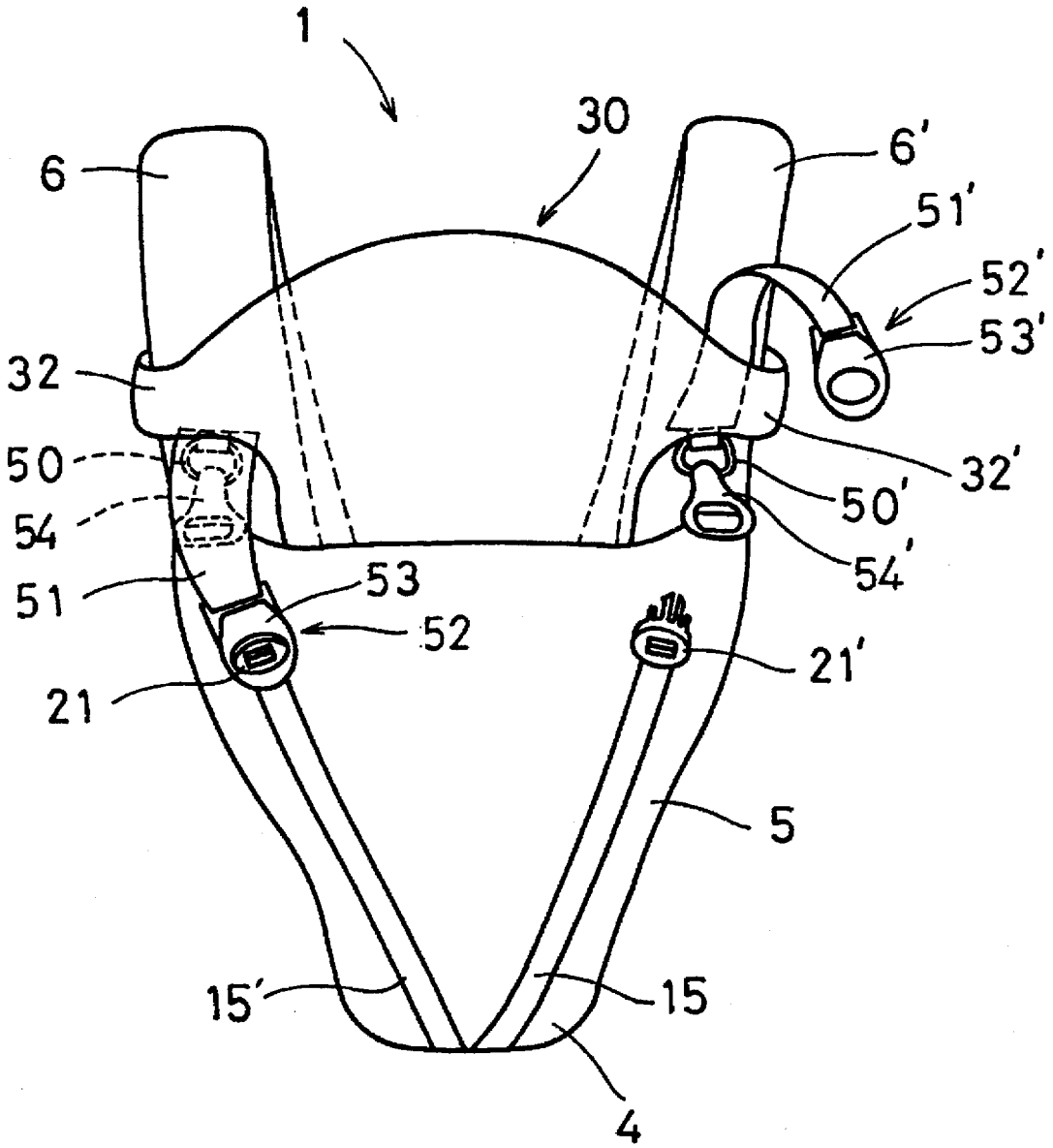
FIG. 6 is a front view of the baby carrier in assembled condition.

In this condition, the nursing person holds the baby in an arm and, while lifting the back cover portion 5 of the carrier body 2 with the other arm, the nursing person draws the baby, together with the back cover portion 5, toward herself or himself, bringing the hook members 54, 54' of the back cover portion 5 into engagement with the ring members 50, 50' of the shoulder belts 6, 6' (see FIG. 6). Thus, the carrier body 2 has now been formed into a bag-like structure and the baby is accommodated therein.

Figure 7:
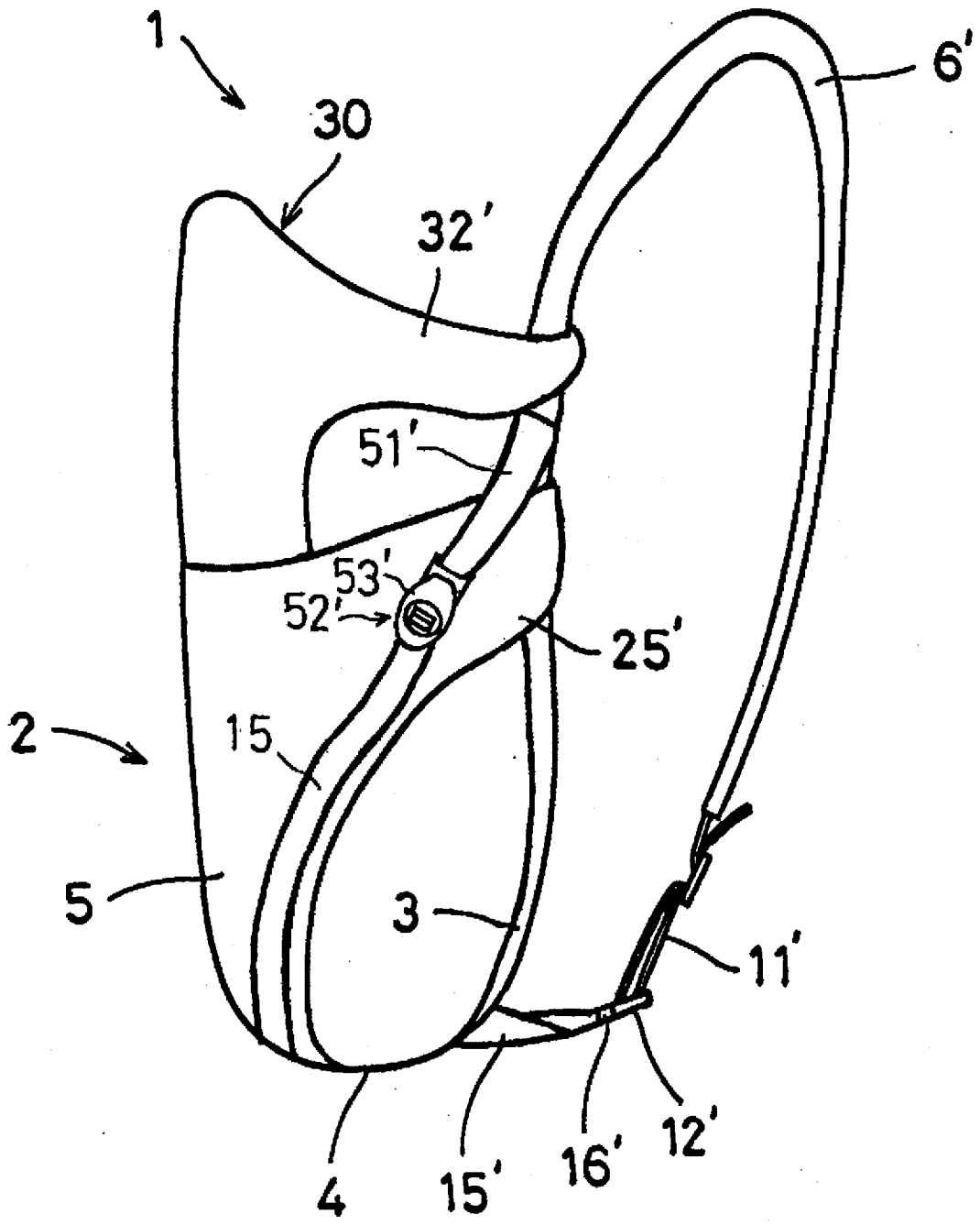
FIG. 7 is a side view of the baby carrier in assembled condition.

Then, while the protective covers 53, 53' of the protective cover-equipped buckles 52, 52' are held open, respective one-touch buckles thereof are brought into engagement with corresponding one-touch buckles 21, 21' on the back cover portion 5 side. After completion of such engagement, the protective covers 53, 53' are closed (see FIGS. 6 and 7).

Figure 8:
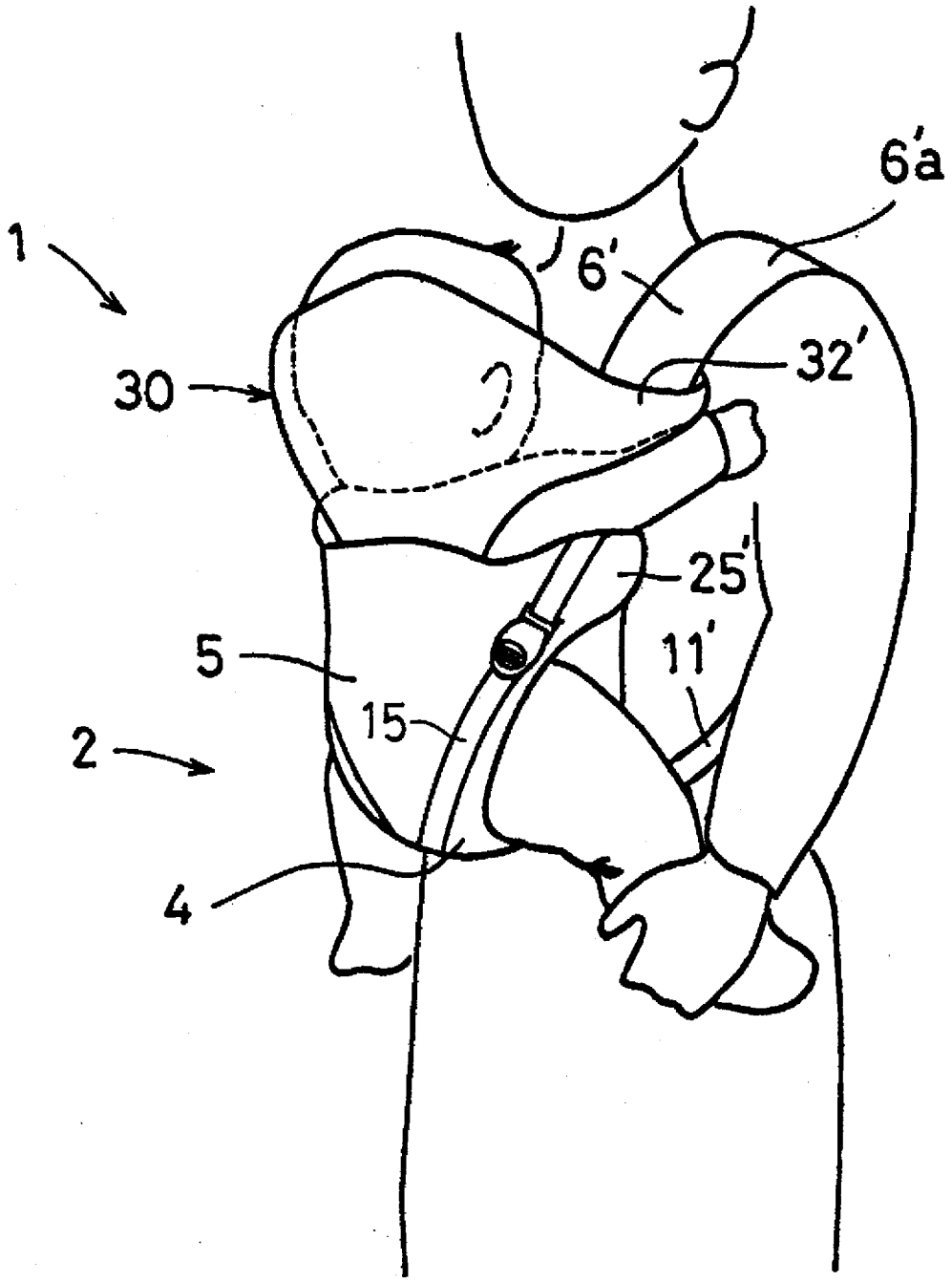
FIG. 8 is a view showing by way of example a baby carrier in use.

Finally, the locking hooks or fasteners 26, 26' at side supports 25, 25' are brought into engagement with the locking hooks or fasteners 27, 27' of the front cover portion 3, whereby the baby carrier 1 is completely assembled as such (see FIG. 8).

In this case, because of the fact that, as already stated, the crotch cover portion 4 is three-dimensionally configured to conform to the contour of the crotch and hip portions of the baby accommodated in the baby carrier 1, any surface pressure acting on the crotch and hip of the baby can be effectively dispersed and uniformly distributed. This prevents troubles that may otherwise be caused to the baby, such as crotch and hip portions getting locally swollen and red, hip joint being exposed to pressure, and hip joint dislocation. In addition, any surface pressure acting on the back of the baby can be evenly distributed.

The above described embodiment comprises the following features in combination:

(a) that the carrier body 2 is comprised of a first cloth material ① including the front cover portion 3, a fifth cloth material ⑤ for the crotch cover portion 4, and a fourth cloth material ④ for the back cover portion 5 which are respectively cut along a cut edge A at a midsection of the crotch cover portion 4 and along a cut edge B at border portions of the crotch cover portion 4 and back cover portion 5, the first and fifth cloth materials ①, ⑤ each having an edge portion of concave pattern extending along cut edge A which defines a respective border portion, the fourth and fifth cloth materials ④, ⑤ each having an edge portion of convex pattern extending along cut edge B which defines a respective border portion, the concave edge portions of the first and fifth cloth materials ①, ⑤ being sewn together, and the fourth and fifth cloth materials ④, ⑤ being sewn together at the convex edge portions thereof, whereby the carrier body 2 is formed as such;

(b) that the crotch cover portion 4 is internally fitted with a pad 8 which serves as a cushioning material;

(c) that a pair of shoulder belts 6, 6' extend downward from both sides of the lower end of the front cover portion 3, the shoulder belts 6, 6' being fitted at an upper location with protective cover-equipped buckles 52, 52' and preferably also D-rings 50, 50', and, at respective lower ends thereof, with one-touch buckles 12, 12';

(d) that at the surface side of the carrier body 2 there are provided first and second belt members 15, 15' which extend in oblique directions and intersect each other at the crotch cover portion 4, lower portions of the first and second belt members 15, 15' extending obliquely downward from a lower portion of the crotch cover portion 4, the first and second belt members 15, 15' being fitted at their distal ends with one-touch buckles 16, 16' which are releasably engageable with the one-touch buckles 12, 12', upper portions of the first and second belt members 15, 15' being disposed within or on the back cover portion 5 and provided with one-touch buckles 21, 21' which are releasably engageable with the protective cover-equipped buckles 52, 52';

(e) that the first and second belt members 15, 15' are fitted up in such a way that they curve in a direction toward each other in a region above their intersecting point in the crotch cover portion 4; and (f) that the belt members curve in a direction toward each other in a region lower than the intersecting point in the crotch cover portion 4.

It is understood, however, the invention is not limited to such a combination of all these features as described with respect to the foregoing embodiment.

The invention may consist of only that part of the feature (a) which relates to cut edge A (hereinafter called "feature (a')"). In that case, as FIG. 3 shows, the carrier body 2 is comprised of a first cloth material ① including the front cover portion 3 which is cut centrally of the crotch cover portion 4 along cut edge A, and a second cloth material ② including the back cover portion 5. In this case, the second cloth material has no cut edge B. The edges of the first and second cloth materials ①, ② extending along the cut edge A are each configured to be of concave shape, and the edges of the two cloth materials ①, ② are sewn together, whereby the carrier body 2 is formed as such. Through this arrangement it is possible to equalize any surface pressure acting on the crotch of the baby.

In another form, the invention may consist of features (a') and (b). In this case, it is possible to equalize the pressure on the crotch of the baby and to protect the crotch joint of the baby, thereby to alleviate the feel of pressure on the crotch joint.

In still another form, the invention may consist of only that portion of feature (a) which relates to cut edge B (hereinafter called "feature (a")"). In this case, as FIG. 3 shows, the carrier body 2 is comprised of a third cloth material ③ including the crotch portion 3 and a fourth cloth material ④ for the back cover portion 5 which are severed along a cut edge B at border portions of the crotch portion 4 and the back portion 5, and the third cloth material ③ has no cut edge A. The edges of the third and fourth cloth materials ③, ④ extending along the cut edge B are each configured to be of convex shape, and the edges of the two cloth materials ③, ④ are sewn together, whereby the carrier body 2 is formed as such. Through this arrangement it is possible to equalize any surface pressure acting on the hip of the baby.

The invention may consist of feature (a) (i.e., features (a') and (a")) only. In this case, it is possible to equalize any surface pressure acting on the crotch and hip portions of the baby.

In another form, the invention may consist of features (a) and (b), in which case it is possible to equalize any surface pressure acting on the crotch and hip portions of the baby and to protect the crotch joint of the baby, thereby to alleviate the feel of pressure on the crotch joint.

Further, the invention may consist of features (a), (b), (c), (d) and (e). In this case, it is possible to equalize any surface pressure acting on the crotch and hip portions of the baby and to protect the crotch joint of the baby, thereby to alleviate the feel of pressure on the crotch joint. In addition, it is possible to alleviate any surface pressure acting upon the back of the baby.

The invention may consist of features (a"), (c), (d) and (e). In this case, it is possible to equalize any surface pressure acting on the hip and back of the baby. In another form, the invention may consist of features (a"), (c), (d), (e) and (f), in which case it is possible to equalize any surface pressure acting on the hip and back of the baby and also to allow the nursing person to bear the weight of the baby without difficulty.

In another form, the invention may consist of features (c), (d), (e) and (f), in which case it is possible to equalize any surface pressure acting on the back of the baby and also to allow the nursing person to bear the weight of the baby without difficulty.

Those skilled in the art to which the invention pertains may make modifications and other embodiments employing the principles of this invention without departing from its spirit or essential characteristics, particularly upon considering the foregoing teachings. The described embodiments are to be considered in all respects only as illustrative and not restrictive and the scope of the invention is, therefore, indicated by the appended claims rather than by the foregoing description. Consequently, while the invention has been described with reference to particular embodiments, modifications of structure, sequence, materials and the like would be apparent to those skilled in the art, yet still fall within the scope of invention.

What is claimed is:

1. A baby carrier including a carrier body having a front cover portion, a crotch cover portion and a back cover portion which are arranged integrally with one another, wherein:

the carrier body comprises a first cloth material including the front cover portion, and a second cloth material including the back cover portion, which are severed from each other at a midsection of the crotch cover portion, wherein the first and second cloth materials each have a respective edge portion of concave pattern where they are severed from each other, and the edge portions of the first and second cloth materials are sewn together to form the carrier body.

2. The baby carrier as set forth in claim 1, further comprising a cushioning material internally fitted in the crotch cover portion.

3. The baby carrier as set forth in claim 1, wherein the first cloth material further integrally includes a first part of the crotch cover portion having the first respective concave edge portion thereon, and the second cloth material further integrally includes a second part of the crotch cover portion having the second respective concave edge portion thereon.

4. The baby carrier as set forth in claim 1, wherein the concave edge portions of the first and second cloth materials are sewn together in such a manner that a surface of the crotch cover portion adapted to face a baby that is to be carried in the carrier has a convexly curved surface configuration at an area along the sewn together edge portions, wherein the convexly curved surface configuration is raised near a center of the crotch cover portion and curves laterally downwardly toward side edges of the crotch cover portion.

5. A baby carrier including a carrier body having a front cover portion, a crotch cover portion and a back cover portion which are arranged integrally with one another, wherein:

the carrier body comprises a first cloth material including the crotch cover portion and a second cloth material including the back cover portion, which are severed from each other at a junction of the crotch cover portion and back cover portion, wherein the first and second cloth materials each have a respective edge portion of convex pattern defining the junction, and the edge portions of the first and second cloth materials are sewn together to form the carrier body.

6. The baby carrier as set forth in claim 5, wherein the first cloth material further integrally includes the front cover portion as a single integral piece with the crotch cover portion.

7. The baby carrier as set forth in claim 5, wherein the convex edge portions of the first and second cloth materials are sewn together in such a manner that a surface of the baby carrier adapted to face a back side of a baby that is to be carried in the carrier has a concavely curved surface configuration along the junction of the crotch cover portion and the back cover portion.

8. A baby carrier including a carrier body having a front cover portion, a crotch cover portion and a back cover portion which are arranged integrally with one another, wherein:

the carrier body comprises a first cloth material including the front cover portion, a second cloth material including at least a part of the crotch cover portion, and a third cloth material including the back cover portion, which are respectively severed from one another at a midsection of the crotch cover portion and at a junction of the crotch cover portion and back cover portion, wherein the first and second cloth materials each have a respective edge portion of concave pattern where they are severed from each other, the second and third cloth materials each have a respective edge portion of convex pattern defining the junction, and the concave edge portions of the first and second cloth materials are sewn together and the convex edge portions of the second and third cloth materials are sewn together to form the carrier body.

9. The baby carrier as set forth in claim 8, further comprising a cushioning material internally fitted in the crotch cover portion.

10. The baby carrier as set forth in claim 8, wherein the concave edge portions of the first and second cloth materials are sewn together and the convex edge portions of the second and third cloth materials are sewn together respectively in such a manner that a surface of the baby carrier adapted to face a baby that is to be carried in the carrier has a convexly curved surface configuration along the sewn together concave edge portions and has a concavely curved surface configuration along the sewn together convex edge portions.

11. A baby carrier including a carrier body having a front cover portion, a crotch cover portion and a back cover portion which are arranged integrally with one another, wherein:

the carrier body comprises a first cloth material including the front cover portion, a second cloth material including at least a part of the crotch cover portion, and a third cloth material including the back cover portion, which are respectively severed from one another at a midsection of the crotch cover portion and at a junction of the crotch cover portion and back cover portion, wherein the first and second cloth materials each have a respective edge portion of concave pattern where they are severed from each other, the second and third cloth materials each have a respective edge portion of convex pattern defining the junction, and the concave edge portions of the first and second cloth materials are sewn together, and the convex edge portions of the second and third cloth materials are sewn together to form the carrier body;

and further comprising:

a cushioning material internally fitted in the crotch cover portion;

a pair of shoulder belts respectively having proximal ends respectively connected to both sides of a distal end of the front cover portion, first fastening elements respectively fitted adjacent the proximal ends of the shoulder belts, and first buckles fitted at respective distal ends of the shoulder belts;

first and second belt members provided at a surface side of the carrier body which extend in oblique directions and intersect each other at the crotch cover portion, wherein distal end portions of the first and second belt members extend obliquely from the crotch cover portion, second buckles which are releasably engageable with the first buckles being fitted at the distal end portions of the first and second belt members, second fastening elements which are releasably engageable with the first fastening elements being provided on proximal end portions of the first and second belt members that are disposed on the back cover portion; and wherein the first and second belt members are fitted such that they curve toward each other in a region of the back cover portion.

12. The baby carrier as set forth in claim 11, wherein the first and second belt members are sewn onto and along the back cover portion in a configuration in which the proximal end portions of the first and second belt members curve toward each other as they extend away from the intersection of the first and second belt members.

13. A baby carrier including a carrier body having a front cover portion, a crotch cover portion and a back cover portion which are arranged integrally with one another, wherein:

the carrier body comprises a first cloth material including the front cover portion, a second cloth material including at least a part of the crotch cover portion, and a third cloth material including the back cover portion, which are respectively severed from one another at a midsection of the crotch cover portion and at a junction of the crotch cover portion and back cover portion, wherein the first and second cloth materials each have a respective, edge portion of concave pattern where they are severed from each other, the second and third cloth materials each have a respective edge portion of convex pattern defining the junction, and the concave edge portions of the first and second cloth materials are sewn together, and the convex edge portions of the second and third cloth materials are sewn together to form the carrier body;

and further comprising:

a cushioning material internally fitted in the crotch cover portion;

a pair of shoulder belts respectively having proximal ends respectively connected to both sides of a distal end of the front cover portion, first fastening elements respectively fitted adjacent the proximal ends of the shoulder belts, and first buckles fitted at respective distal ends of the shoulder belts;

first and second belt members provided at a surface side of the carrier body which extend in oblique directions and intersect each other at the crotch cover portion, wherein distal end portions of the first and second belt members extend obliquely from the crotch cover portion, second buckles which are releasably engageable with the first buckles being fitted at the distal end portions of the first and second belt members, second fastening elements which are releasably engageable with the first fastening elements being provided on proximal end portions of the first and second belt members that are disposed on the back cover portion; and wherein the first and second belt members are fitted such that they curve toward each other in a region of the back cover portion, and further such that they curve toward each other in a region of the front cover portion.

14. The baby carrier as set forth in claim 13, wherein the first and second belt members are sewn onto and along at least the back cover portion and the crotch cover portion in a configuration in which the proximal end portions of the first and second belt members curve toward each other and the distal end portions of the first and second belt members curve toward each other as the end portions respectively extend away from the intersection of the first and second belt members, and in which each of the first and second belt members has a substantially S-shaped curvature.

15. The baby carrier as set forth in claim 13, wherein respective obtuse angles are formed between the proximal end portions of the first and second belt members and between the distal end portions of the first and second belt members at the intersection of the first and second belt members.

16. A baby carrier including a carrier body having a front cover portion, a crotch cover portion and a back cover portion which are arranged integrally with one another, wherein:

the carrier body comprises a first cloth material including the crotch cover portion and a second cloth material including the back cover portion, which are severed from each other at a junction of the crotch cover portion and back cover portion, wherein the first and second cloth materials each have a respective edge portion of convex pattern defining the junction, and the edge portions of the first and second cloth materials are sewn together to form the carrier body;

and further comprising:

a pair of shoulder belts respectively having proximal ends respectively connected to both sides of a distal end of the front cover portion, first fastening elements respectively fitted adjacent the proximal ends of the shoulder belts, and first buckles fitted at respective distal ends of the shoulder belts;

first and second belt members provided at a surface side of the carrier body which extend in oblique directions and intersect each other at the crotch cover portion, wherein distal end portions of the first and second belt members extend obliquely from the crotch cover portion, second buckles which are releasably engageable with the first buckles being fitted at the distal end portions of the first and second belt members, second fastening elements which are releasably engageable with the first fastening elements being provided on proximal end portions of the first and second belt members that are disposed on the back cover portion; and wherein the first and second belt members are fitted such that they curve toward each other in a region of the back cover portion.

17. The baby carrier as set forth in claim 16, wherein the first and second belt members are sewn onto and along the back cover portion in a configuration in which the proximal end portions of the first and second belt members curve toward each other as they extend away from the intersection of the first and second belt members.

18. A baby carrier including a carrier body having a front cover portion, a crotch cover portion and a back cover portion which are arranged integrally with one another wherein:

the carrier body comprises a first cloth material including the crotch cover portion and a second cloth material including the back cover portion, which are severed from each other at a junction of the crotch cover portion and back cover portion, wherein the first and second cloth materials each have a respective edge portion of convex pattern defining the junction, and the edge portions of the first and second cloth materials are sewn together to form the carrier body;

and further comprising:

a pair of shoulder belts respectively having proximal ends respectively connected to both sides of a distal end of the front cover portion, first fastening elements respectively fitted adjacent the proximal ends of the shoulder belts, and first buckles fitted at respective distal ends of the shoulder belts;

first and second belt members provided at a surface side of the carrier body which extend in oblique directions and intersect each other at the crotch cover portion, wherein distal end portions of the first and second belt members extend obliquely from the crotch cover portion, second buckles which are releasably engageable with the first buckles being fitted at the distal end portions of the first and second belt members, second fastening elements which are releasably engageable with the first fastening elements being provided on proximal end portions of the first and second belt members that are disposed on the back cover portion; and wherein the first and second belt members are fitted such that they curve toward each other in a region of the back cover portion, and further such that they curve toward each other in a region of the front cover portion.

19. The baby carrier as set forth in claim 18, wherein the first and second belt members are sewn onto and along at least the back cover portion and the crotch cover portion in a configuration in which the proximal end portions of the first and second belt members curve toward each other and the distal end portions of the first and second belt members curve toward each other as the end portions respectively extend away from the intersection of the first and second belt members, and in which each of the first and second belt members has a substantially S-shaped curvature.

20. The baby carrier as set forth in claim 18, wherein respective obtuse angles are formed between the proximal end portions of the first and second belt members and between the distal end portions of the first and second belt members at the intersection of the first and second belt members.

* * * * *

UNITED STATES PATENT AND TRADEMARK OFFICE
CERTIFICATE OF CORRECTION

PATENT NO. : 5,690,258

DATED : Nov. 25, 1997

INVENTOR(S) : Kataoka

It is certified that error appears in the above-identified patent and that said Letters Patent is hereby corrected as shown below:

Col. 1, line 21, replace "shade" by --shape--;
line 22, replace "hid" by --hip--.

Col. 2, line 39, after "in" (first occurrence) insert --or on--.

Col. 4, line 23, replace "outward" by --downward--.

Col. 9, line 57, delete ",".

Col. 2, line 39, after "in" (second occurrence) delete --or on--.

Signed and Sealed this

Seventeenth Day of March, 1998

*Attest:*

*Attesting Officer*

BRUCE LEHMAN

*Commissioner of Patents and Trademarks*